US009853339B2

(12) United States Patent
Yatabe

(10) Patent No.: US 9,853,339 B2
(45) Date of Patent: Dec. 26, 2017

(54) DIELECTRIC WAVEGUIDE INPUT/OUTPUT STRUCTURE AND DIELECTRIC WAVEGUIDE FILTER USING THE SAME

(71) Applicant: TOKO, INC., Tsurugashima-shi (JP)

(72) Inventor: Yukikazu Yatabe, Tsurugashima (JP)

(73) Assignee: Murata Manufacturing Co., Ltd., Nagaokakyo-Shi (JP)

( * ) Notice: Subject to any disclaimer, the term of this patent is extended or adjusted under 35 U.S.C. 154(b) by 128 days.

(21) Appl. No.: 15/048,572

(22) Filed: Feb. 19, 2016

(65) Prior Publication Data

US 2016/0268667 A1 Sep. 15, 2016

(30) Foreign Application Priority Data

Mar. 13, 2015 (JP) ..... 2015-050463

(51) Int. Cl.

| | |
|---|---|
| ***H01P 3/16*** | (2006.01) |
| ***H01P 1/20*** | (2006.01) |
| ***H01P 5/08*** | (2006.01) |

(52) U.S. Cl.

CPC ..... *H01P 1/2002* (2013.01); *H01P 3/16* (2013.01); *H01P 5/087* (2013.01)

(58) Field of Classification Search

CPC ..... H01P 3/16; H01P 5/087; H01P 1/2002

USPC .... 333/248, 202, 212, 208, 209, 210, 219.1, 333/219, 230

See application file for complete search history.

(56) References Cited

U.S. PATENT DOCUMENTS

| | | | | |
|---|---|---|---|---|
| 7,196,598 | B2 * | 3/2007 | Maruhashi | H01P 1/2088 333/212 |
| 7,872,550 | B2 * | 1/2011 | Chuang | H01P 1/047 333/208 |
| 2003/0016100 | A1 | 1/2003 | Kojima et al. | |
| 2007/0120628 | A1 * | 5/2007 | Jun | H01P 1/2088 333/208 |
| 2009/0243762 | A1 * | 10/2009 | Chen | H01P 1/2088 333/212 |

FOREIGN PATENT DOCUMENTS

| | | |
|---|---|---|
| JP | 2002-135003 | 5/2002 |
| JP | 2003-110307 | 4/2003 |
| JP | 2003-318614 | 11/2003 |
| WO | WO 02/078119 | 10/2002 |

* cited by examiner

*Primary Examiner* — Stephen E Jones
(74) *Attorney, Agent, or Firm* — Cozen O'Connor

(57) ABSTRACT

[Technical problem]
A conventional dielectric waveguide input/output structure has a strength of coupling which is adjusted by a length of an input/output electrode. However, there is a limitation in an adjustable range of the coupling, which makes it impossible to have an input/output structure with wider bandwidth.
[Solution to the technical problem]
A dielectric waveguide input/output structure is provided, which comprises an input/output point provided near the center on one side of a bottom surface of a rectangular parallelepiped-shaped dielectric body, wherein an outer periphery of the dielectric body is covered with an electrically conductive film, except for an L-shaped lateral part extending along an edge of the bottom surface from opposite sides of the input/output point and for a surrounding part of the input/output point in a lateral surface with which the input/output point is in contact.

5 Claims, 6 Drawing Sheets

DIELECTRIC WAVEGUIDE INPUT/OUTPUT STRUCTURE AND DIELECTRIC WAVEGUIDE FILTER USING THE SAME

CROSS-REFERENCE TO RELATED APPLICATION

Basic application: Japanese Patent Application No. 2015-050463 filed on Mar. 13, 2015.

BACKGROUND OF THE INVENTION

1. Field of the Invention

The present invention relates to an input/output structure of a dielectric waveguide, and, in particular, to an input/output structure suitable for mounting on a printed circuit board, and the like.

2. Description of the Related Art

There has been used a dielectric waveguide input/output structure comprising an input/output electrode formed on a bottom surface and lateral walls of a dielectric waveguide resonator which performs input and output, as an input/output structure for directly mounting, on a printed circuit board, a dielectric waveguide filter, a dielectric waveguide duplexer, or the like comprising a plurality of dielectric waveguide resonators coupled to each other.

FIG. 8 is a lower perspective view illustrating an example of a dielectric waveguide filter comprising a conventional dielectric waveguide input/output structure described in JP 2002-135003A. A dielectric waveguide filter 100 comprises dielectric waveguide resonators 102, 102 having a rectangular parallelepiped shape as an outer shape and TE mode as a resonant mode. The dielectric waveguide resonators 102, 102 are coupled to each other via a slit 103. In a bottom surface 102*b* of each of the dielectric waveguide resonators 102, 102, there is provided a band-like input/output electrode 105 that extends from the center on one side of the bottom surface 102*b* to a direction of opposing sides. Each dielectric waveguide resonator 102 is covered with an electrically conductive film, except for opposite sides 106, 106 of the input/output electrode 105 and for a lateral opening 107 surrounding the input/output electrode 105 in a lateral surface 102*a* with which the input/output electrode 105 is in contact.

BRIEF SUMMARY OF THE INVENTION

Problem to be Solved by the Invention

The dielectric waveguide input/output structure as described above has a strength of coupling which is adjusted by a length of the input/output electrode. However, there is a limitation in an adjustable range of the coupling, which makes it impossible to have an input/output structure with wider bandwidth.

Means for Solving the Problem

A dielectric waveguide input/output structure of the present invention comprises an input/output point provided near the center on one side of a bottom surface of a rectangular parallelepiped-shaped dielectric body, wherein an outer periphery of the dielectric body is covered with an electrically conductive film, except for an L-shaped lateral part extending along an edge of the bottom surface from opposite sides of the input/output point and for a surrounding part of the input/output point in a lateral surface with which the input/output point is in contact.

Effect of the Invention

According to the present invention, it becomes possible to provide an input/output structure with wider bandwidth, having wider adjustable range of coupling.

DETAILED DESCRIPTION OF THE INVENTION

Figure 1A:
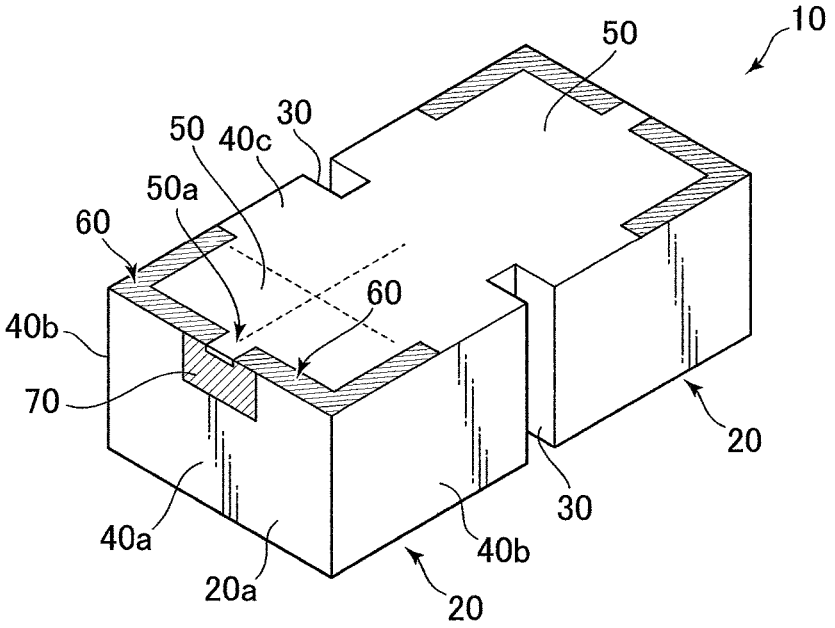
FIG. 1A illustrates an embodiment of a dielectric waveguide filter comprising a dielectric waveguide input/output structure of the present invention.

FIG. 1A illustrates a perspective view for explaining an embodiment of a dielectric waveguide filter comprising a dielectric waveguide input/output structure of the present invention, with a bottom surface up.

Figure 1B:
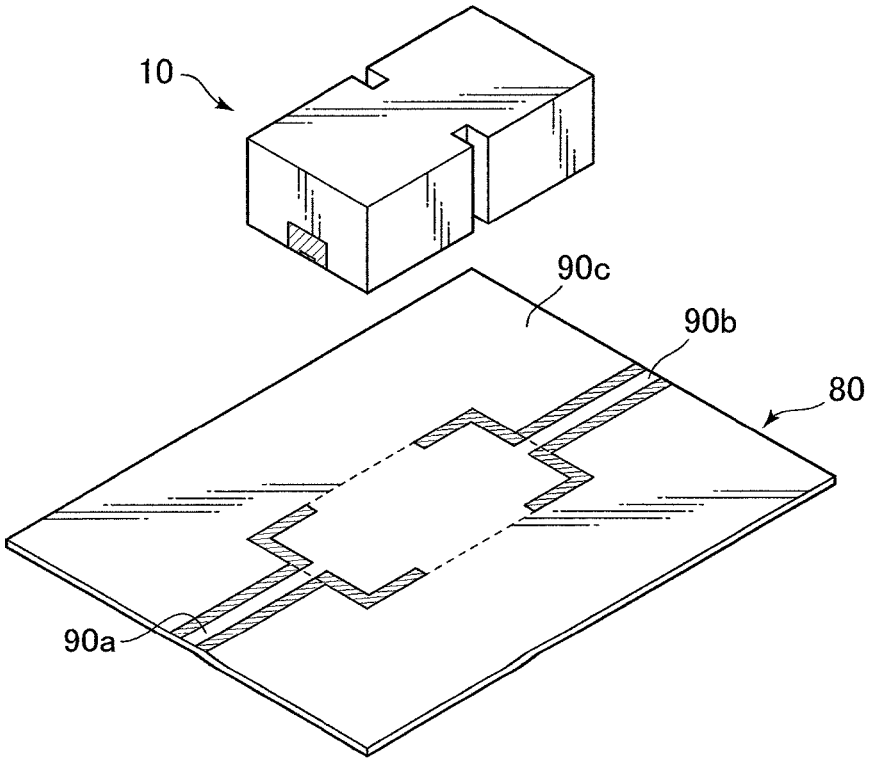
FIG. 1B illustrates an example of mounting the dielectric waveguide filter in FIG. 1A on a substrate.

FIG. 1B illustrates a perspective view for explaining mounting of the dielectric waveguide filter illustrated in FIG. 1A on a substrate.

As illustrated in FIG. 1A, a dielectric waveguide filter 10 comprises dielectric waveguide resonators 20, 20, each consisting of a rectangular parallelepiped-shaped dielectric body, and having TE mode as a resonant mode. The dielectric waveguide resonators 20, 20 are coupled to each other via a slit 30.

Each of the dielectric waveguide resonators 20, 20 comprises a rectangular input/output electrode 50 defining an input/output point 50*a* near the central region on one side of a bottom surface 40*c*, and is covered with an electrically conductive film 20*a*, except for an L-shaped lateral parts 60, 60 extending along an edge of the bottom surface 40*c* from opposite sides of the input/output point 50*a*, and for a lateral opening 70 surrounding the input/output point 50*a* in a lateral surface 40*a* of the dielectric waveguide resonator with which the input/output point 50*a* is in contact.

As illustrated in FIG. 1B, the dielectric waveguide filter 10 is mounted on a printed circuit board 80 which comprises lines 90*a*, 90*b* each having a distal end formed in an approximately the same shape as the input/output electrode 50, and a ground pattern 90*c*. In this case, the distal end of each of the lines 90*a*, 90*b* is connected to respective one of the input/output electrodes 50, 50, and the electrically conductive film 20*a* is connected to the ground pattern 90*c*. The lines 90*a*, 90*b* are, for example, microstrip lines or coplanar lines.

Figure 2:
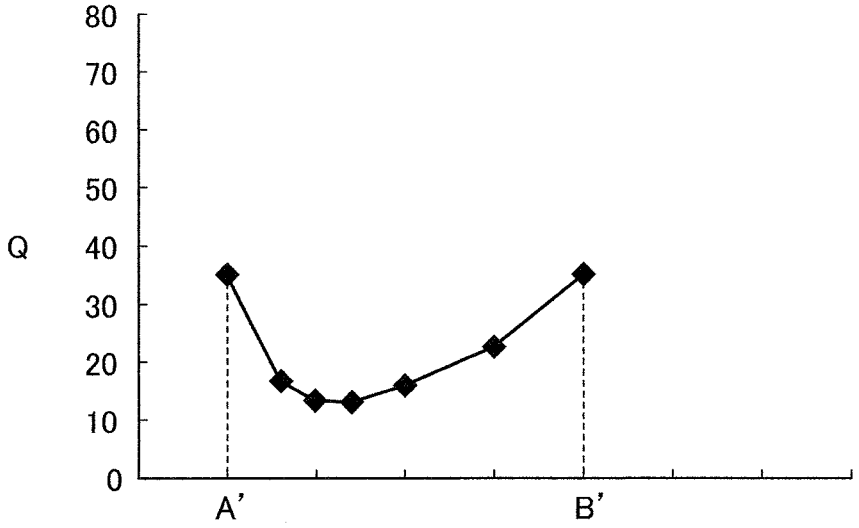
FIG. 2 illustrates a simulation result of an external Q of a conventional dielectric waveguide input/output structure.

FIG. 2 illustrates a graph of a result of simulating a dielectric waveguide filter comprising a conventional dielectric waveguide input/output structure.

Figure 3:
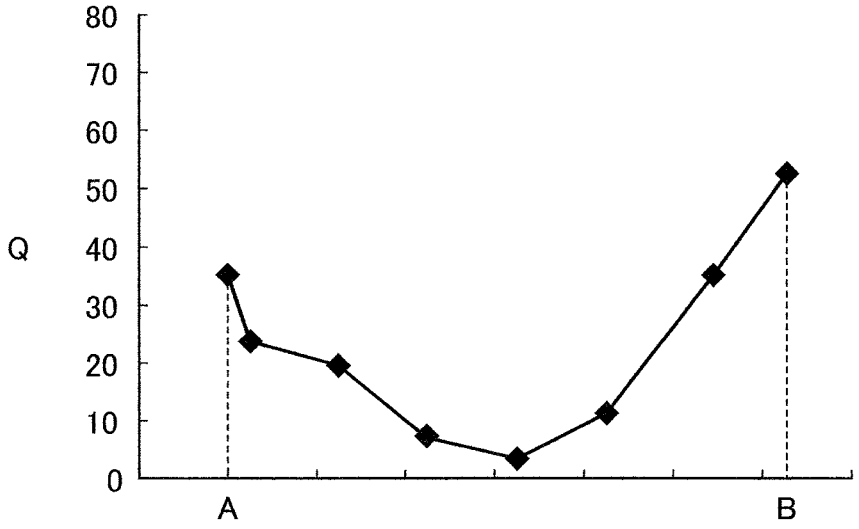
FIG. 3 illustrates a simulation result of an external Q of the dielectric waveguide input/output structure of the present invention.

FIG. 3 illustrates a graph of a result of simulating a dielectric waveguide filter comprising the dielectric waveguide input/output structure of the present invention.

Figure 4A:
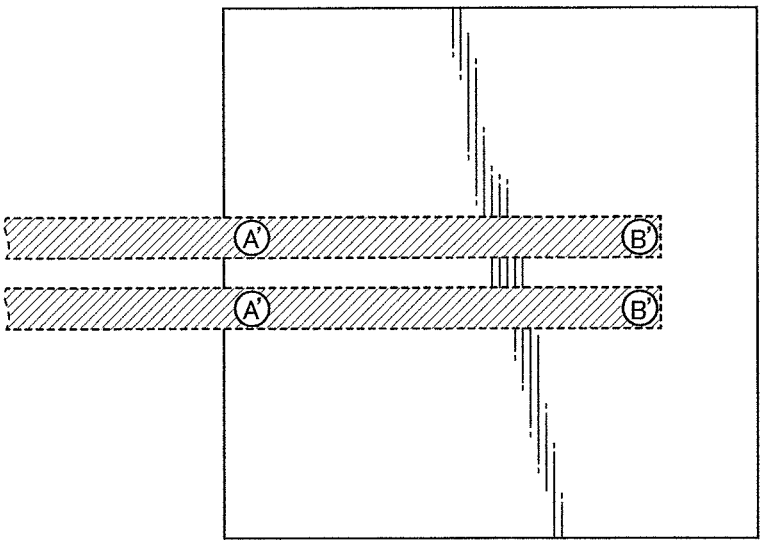
FIG. 4A is a diagram for explaining a horizontal axis of FIG. 2.

In FIG. 2, the horizontal axis represents a relative length between lateral parts A' and B' in the illustration of FIG. 4A, and the vertical axis represents an external Q.

Figure 4B:
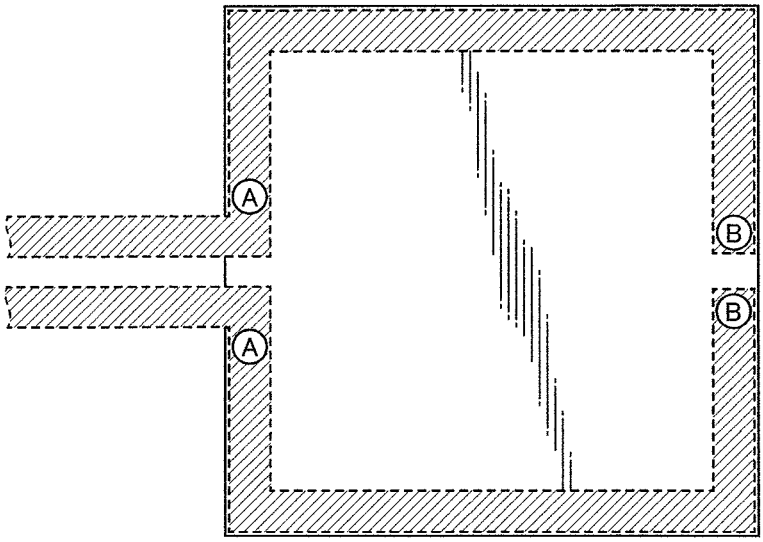
FIG. 4B is a diagram for explaining a horizontal axis of FIG. 3.

In FIG. 3, the horizontal axis represents a relative length between lateral parts A and B in the illustration of FIG. 4B, and the vertical axis represents an external Q. It is noted that the external Q is a reciprocal of coupling.

It can be seen from the results of FIGS. 2 and 3 that the dielectric waveguide input/output structure of the present invention has a lower minimum value of external Q as compared to the conventional dielectric waveguide input/output structure, and that the external Q becomes minimum when a distal end of edge is near the central portion of adjacent side.

This is considered to occur for the following reason.

Figure 5:
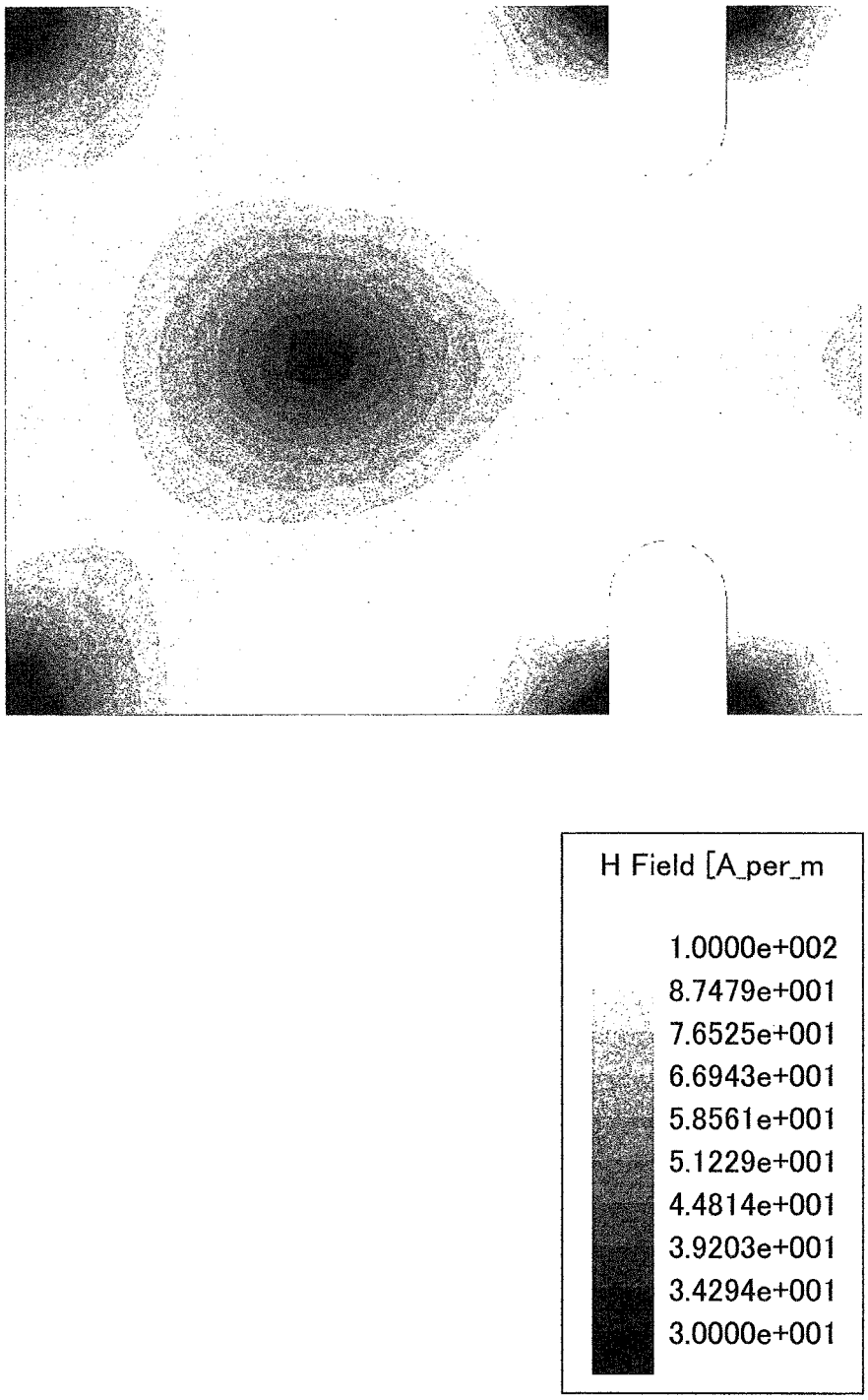
FIG. 5 illustrates a result of simulating a magnetic-field strength distribution inside a resonator.

FIG. 5 illustrates a result of simulating a magnetic-field strength distribution inside a resonator. As illustrated in the simulation of FIG. 5, the magnetic field is strongest in lateral sides near the center of the resonator, and weakest in the center and corners of the resonator.

Figure 6A:
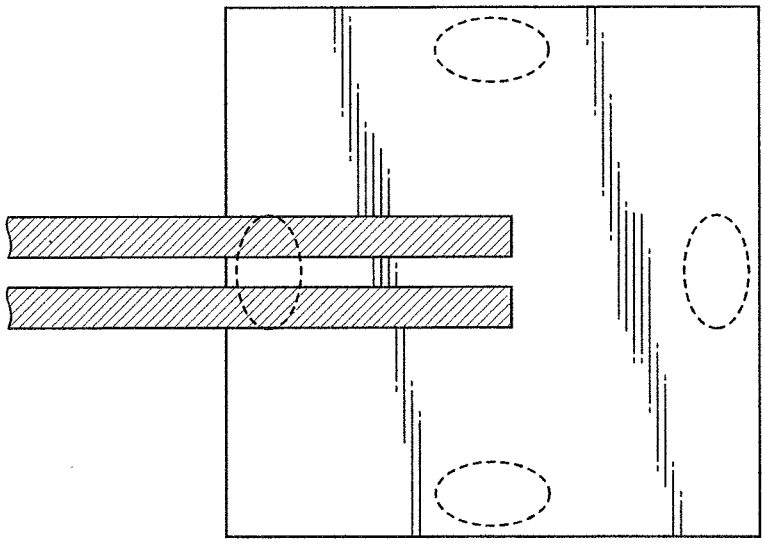
FIG. 6A schematically illustrates the conventional dielectric waveguide input/output structure.
Figure 6B:
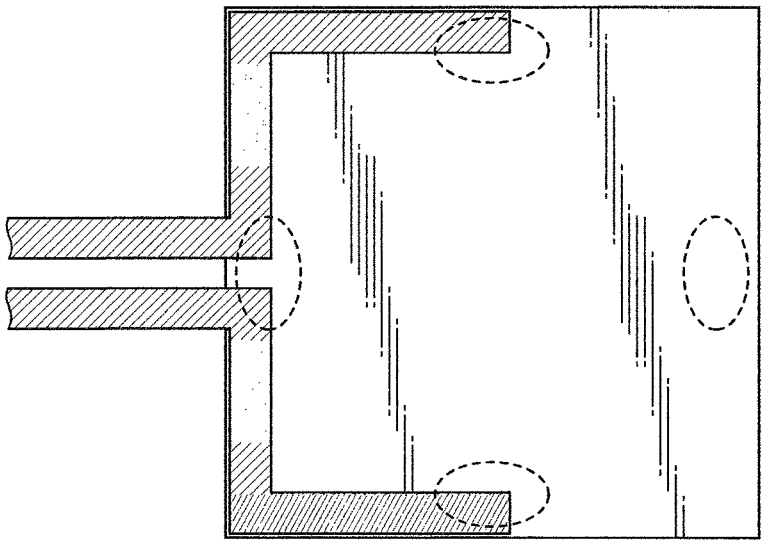
FIG. 6B schematically illustrates the dielectric waveguide input/output structure of the present invention.

FIG. 6A schematically illustrates the conventional dielectric waveguide input/output structure, and FIG. 6B schematically illustrates the dielectric waveguide input/output structure of the present invention. In FIGS. 6A and 6B, dashed lines indicate locations with the largest magnetic field in the result of FIG. 5.

The conventional dielectric waveguide input/output structure illustrated in FIG. 6A intersects with the lateral part at only one location of the locations with largest magnetic field in the dielectric resonator, whereas the dielectric waveguide input/output structure of the present invention illustrated in FIG. 6B intersects with the lateral part at three locations of the locations with largest magnetic field in the dielectric resonator.

For this reason, it is possible for the latter to have a smaller external Q.

Since the dielectric waveguide input/output structure of the present invention enables the adjustable range of coupling to be wider than the conventional dielectric waveguide input/output structure in this way, it becomes possible to have an input/output structure with wider bandwidth.

It is noted that when the dielectric waveguide is mounted on a substrate, the electromagnetic field is likely to leak from a small gap between a lateral surface and a bottom surface of the dielectric waveguide, making the coupling strength reduced. A fillet formed by a solder between the substrate and the lateral surface of the dielectric waveguide can easily prevent the leakage of the electromagnetic field.

Figure 7:
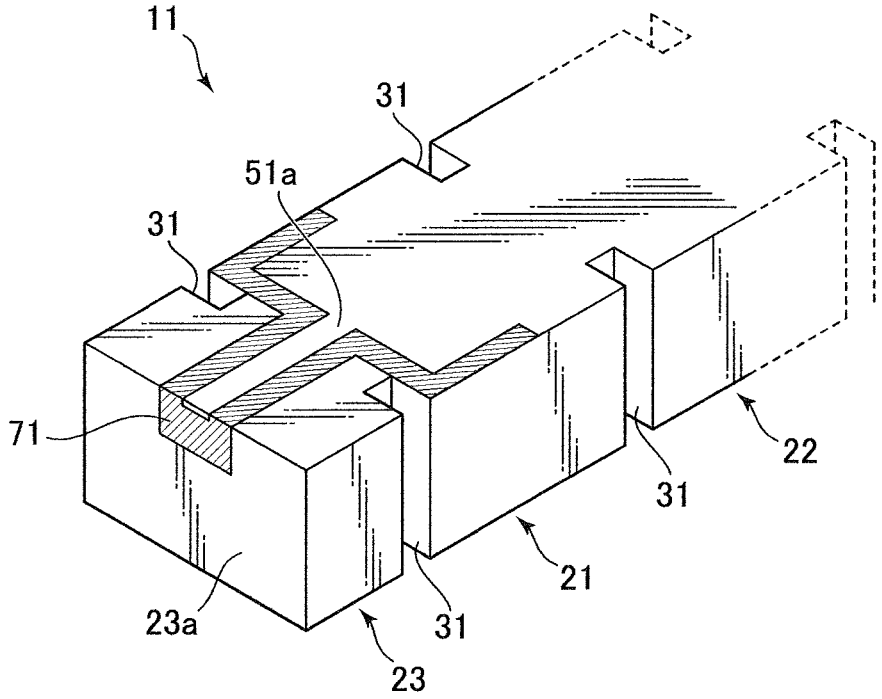
FIG. 7 illustrates an alternative embodiment of the dielectric waveguide input/output structure of the present invention.
Figure 8:
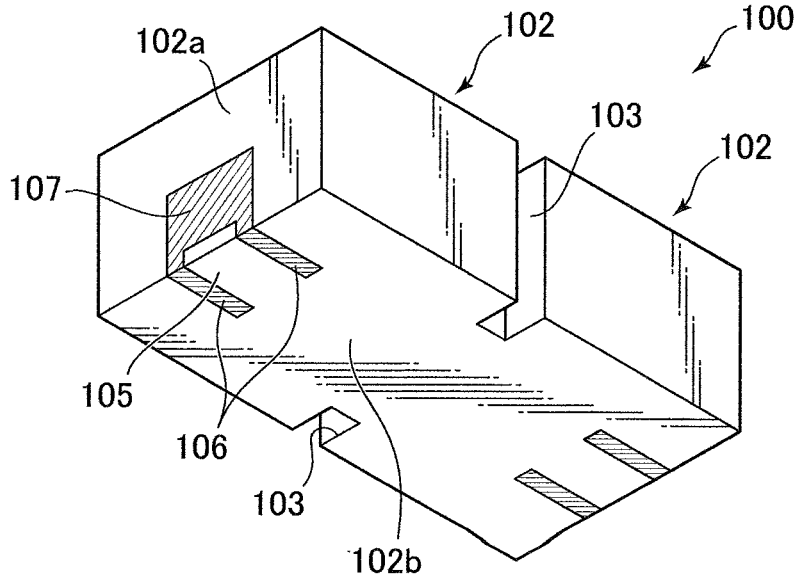
FIG. 8 illustrates an example of the conventional dielectric waveguide input/output structure.

FIG. 7 is a perspective view illustrating an alternative embodiment of a dielectric waveguide filter comprising the dielectric waveguide input/output structure of the present invention, with a bottom surface up.

As illustrated in FIG. 7, a dielectric waveguide filter 11 comprises rectangular parallelepiped-shaped dielectric waveguide resonators 21, 22 and a rectangular parallelepiped-shaped dielectric block 23 that is smaller than the dielectric waveguide resonators 21, 22, which are serially connected via a slit 31.

An input/output point 51*a* provided on one side of a bottom surface of the dielectric waveguide resonator 21 is extended across the bottom surface to an end surface 23*a* of the adjacently-disposed dielectric block 23.

By having such a structure, the leakage of the electromagnetic field at the input/output point can be prevented.

It is noted that the dielectric waveguide input/output structure is not necessarily required to be provided in the resonators positioned at either end of the dielectric waveguide filter.

If other dielectric waveguide resonators are located on opposite sides of a dielectric waveguide resonator, it may have an input/output point provided on one side of the bottom surface thereof that is not adjacent to the other dielectric waveguide resonators.

EXPLANATION OF CODES

10, 11, 12, 13, 100: dielectric waveguide filter
20, 21, 22*a* to 22*f*, 23*a* to 23*f*, 102: dielectric waveguide resonator
30, 31, 103: slit
40*a*, 40*b*, 41*a*, 41*b*, 102*a*: lateral surface
40*c*, 102*b*: bottom surface
50, 51, 105: input/output electrode
50*a*, 51*a*: input/output point
60, 61, 106: lateral part
70, 71, 107: lateral opening
80, 81, 82, 83: printed circuit board
90*a*, 90*b*, 91*a*, 91*b*, 92*a*, 92*b*, 93*a*, 93: line
90*c*: ground pattern

The invention claimed is:

1. A dielectric waveguide input/output structure comprising an input/output point provided near the center on one side of a bottom surface of a rectangular parallelepiped-shaped dielectric body, wherein an outer periphery of the dielectric body constituting a dielectric waveguide resonator is covered with an electrically conductive film, except for an L-shaped lateral part extending along an edge of the bottom surface from opposite sides of the input/output point, and for a surrounding part of the input/output point in a lateral surface with which the input/output point is in contact.

2. The dielectric waveguide input/output structure as defined in claim 1, wherein a dielectric block that is smaller than the dielectric waveguide resonator is disposed adjacent to the dielectric waveguide resonator, and the input/output point extends across a bottom surface of the dielectric block to an end surface of the dielectric block.

3. A dielectric waveguide filter comprising the dielectric waveguide input/output structure as defined in claim 1.

4. The dielectric waveguide input/output structure as defined in claim 1, wherein the input/output point is connected to a line provided on a substrate, and an exterior of the dielectric body is connected to a ground pattern provided on the substrate.

5. The dielectric waveguide input/output structure as defined in claim 4, wherein a fillet is formed between a lateral surface of the dielectric body and the ground pattern.

* * * * *